United States Patent [19]

Ayres et al.

[11] Patent Number: 4,783,210

[45] Date of Patent: Nov. 8, 1988

[54] AIR SEPARATION PROCESS WITH MODIFIED SINGLE DISTILLATION COLUMN NITROGEN GENERATOR

[75] Inventors: Calvin L. Ayres, New Tripoli; Joseph M. Abrardo, Schnecksville; Edwin C. Rogusky, Catasauqua, all of Pa.

[73] Assignee: Air Products and Chemicals, Inc., Allentown, Pa.

[21] Appl. No.: 132,534

[22] Filed: Dec. 14, 1987

[51] Int. Cl.[4] ..... F25J 3/02

[52] U.S. Cl. ..... 62/24; 62/39

[58] Field of Search ..... 62/23, 24, 39

[56] References Cited

U.S. PATENT DOCUMENTS

| | | | |
|---|---|---|---|
| 2,627,731 | 2/1953 | Benedict | 62/175.5 |
| 2,982,108 | 5/1961 | Grunberg | 62/28 |
| 3,210,951 | 10/1965 | Gaumer | 62/29 |
| 3,214,926 | 11/1965 | Shalevitz | 62/14 |
| 3,217,502 | 11/1965 | Keith | 62/13 |
| 3,277,655 | 10/1965 | Geist et al. | 62/29 |
| 3,327,489 | 6/1967 | Gaumer | 62/29 |
| 3,492,828 | 2/1970 | Ruckborn | 62/13 |
| 3,731,495 | 5/1973 | Coveney | 62/39 |
| 3,735,599 | 5/1973 | Izumichi et al. | 62/21 |
| 3,736,762 | 6/1973 | Toyama et al. | 62/13 |
| 3,754,406 | 8/1973 | Allam | 62/41 |
| 4,222,756 | 9/1980 | Thorogood | 62/13 |
| 4,224,045 | 9/1980 | Olszewski | 62/30 |
| 4,356,014 | 10/1982 | Higgins | 62/24 |
| 4,382,366 | 5/1983 | Gaumer III | 62/31 |
| 4,406,188 | 8/1983 | Patel et al. | 62/13 |
| 4,453,957 | 6/1984 | Pahade et al. | 62/25 |
| 4,464,188 | 8/1984 | Agrawal et al. | 62/13 |
| 4,464,191 | 8/1984 | Erickson | 62/31 |
| 4,560,397 | 12/1985 | Cheung | 62/28 |
| 4,617,036 | 10/1986 | Suchdeo et al. | 62/11 |
| 4,617,037 | 10/1986 | Okada et al. | 62/11 |
| 4,655,809 | 4/1987 | Shenoy | 62/18 |
| 4,662,916 | 5/1987 | Agrawal et al. | 62/13 |
| 4,662,917 | 5/1987 | Cormier et al. | 62/13 |
| 4,662,918 | 5/1987 | Agrawal et al. | 62/13 |
| 4,702,757 | 10/1987 | Kleinberg | 62/24 |
| 4,704,147 | 11/1987 | Kleinberg | 62/24 |
| 4,704,148 | 11/1987 | Kleinberg | 62/24 |

*Primary Examiner*—Ronald C. Capossela

*Attorney, Agent, or Firm*—Willard Jones, II; William F. Marsh; James C. Simmons

[57] ABSTRACT

The present invention relates to a process to produce large quantities of pure nitrogen and small amounts of high purity oxygen co-product which utilizes a modified single distillation column nitrogen generator. The modification is the addition of a small second column which purifies a portion of the oxygen enriched liquid from the nitrogen generator overhead condenser. Reboiling for the second column is provided by condensing part of the nitrogen overhead from the nitrogen generator. This condensed nitrogen is used as reflux in the nitrogen generator.

2 Claims, 3 Drawing Sheets

AIR SEPARATION PROCESS WITH MODIFIED SINGLE DISTILLATION COLUMN NITROGEN GENERATOR

TECHNICAL FIELD

The present invention is directed to the separation of air into a high purity oxygen product stream and a high purity nitrogen product stream.

BACKGROUND OF THE PRIOR ART

Various processes have been known and utilized in the prior art for the separation of air into its nitrogen and oxygen dominant constituents. Additionally, the use of a single pressure distillation column is known to have been used in the prior art for such separations.

U.S. Pat. No. 2,627,731 discloses a process for the rectification of air into oxygen and nitrogen, wherein a two sectioned or single distillation column are used alternatively. Air is cooled by heat exchange and introduced directly into the distillation column. A nitrogen product is removed from the overhead of the column and a portion is compressed in two stages. The first stage nitrogen compressed stream is recycled in order to reboil and condense a portion of the midpoint of the column by indirect heat exchange before being introduced into the overhead of the column as reflux. A second stage compressed nitrogen stream is recycled and partially expanded to provide refrigeration. This expanded stream is recycled to the nitrogen product line. The remaining stream of the second stage compressed nitrogen stream reboils the bottom of the column before being combined with the first stage compressed nitrogen stream and introduced into the overhead of the column as reflux.

U.S. Pat. No. 2,982,108 discloses an oxygen producing air separation system wherein a portion of the nitrogen generated from the distillation column is compressed and reboils the base of a high pressure section of the column before being introduced as reflux to the low pressure section of the column. The feed air stream is supplied in separate substreams into the high pressure section of the column and in an expanded form into the low pressure section of the column.

U.S. Pat. No. 3,210,951 discloses a fractionation cycle employing first and second fractionating zones operating under different pressures and including two reboiler/condensers. Both of the reboiler/condensers are interconnected with the stages of fractionation in such a manner as to effect the required reboil and reflux production with minimum pressure differential between the stages of rectification and also decreased the irreversibility of the overall fractionation process thereby obtaining the desired separation with the high pressure stage operating under substantially reduced pressure.

U.S. Pat. No. 3,214,926 discloses a method for producing liquid oxygen or liquid nitrogen. However, in the patent it is necessary to have two distillation columns, one at high pressure and another at low pressure in order to extract liquid oxygen.

U.S. Pat. No. 3,217,502 discloses a system which utilizes a single pressure distillation column. The product of this air separation system is gaseous and liquid nitrogen. Impure oxygen which is separated out in this system is vented to waste. In this patent, it is the oxygen waste stream which is expanded in order to provide refrigeration for the air separation system.

U.S. Pat. No. 3,277,655 discloses an improvement to the fractionation process taught in U.S. Pat. No. 3,210,951. In this process, the heat exchange occurring in one of the two reboiler/condensers between the bottoms liquid from the lower pressure column and the gaseous material from the high pressure column results in complete vaporization of the liquid from the low pressure column thereby satisfying the reboiler requirements of the low pressure column. Additionally, when the liquefied gaseous material from the high pressure column is introduced into the lower pressure column it improves the reflux ratio in the upper portion of the low pressure column which increases the separation efficiency and makes it possible to lower the pressure of the gaseous mixture entering the cycle.

U.S. Pat. No. 3,327,489 discloses another improvement to U.S. Pat. NO. 3,210,951 to lowr the pressure in the high pressure fractionator. In the process, the pressure reduction is obtained along with the associated power reduction by establishing a heat exchange between gaseous material, which may comprise the feed mixture, and a liquid component collecting in the bottom of the low pressure fractionator, with the liquid component being under different pressure.

U.S. Pat. No. 3,492,828 discloses a process for the production of oxygen and nitrogen from air wherein a nitrogen recycle stream is compressed and condensed in a reboiler in the base of a distillation column before being reintroduced into the column as reflux. A portion of the nitrogen recycle stream may be expanded in which the power provided by the expansion drives the compressor for the main nitrogen recycle stream.

U.S. Pat. No. 3,731,495 discloses an air separation system using an air feed compressor which is powered by combustion gases directed through a turbine. The turbine exhaust heats boiler steam to supplement the compressor drive. Electric generation is also considered. In addition, this reference utilizes two separate columns at separate pressures for the recovery of the individual gaseous components of air which are separated.

U.S. Pat. No. 3,735,599 discloses a control system for an air separation apparatus which comprises a reversing heat exchanger, an air liquefier, a single column rectifier provided with a condenser-evaporator and a cold generation device. In the apparatus, air is cooled in the reversing heat exchanger and liquefied in the air liquefier, the liquefied air is rectified in the single column to separate into liquid air abundantly containing oxygen and highly pure nitrogen.

U.S. Pat. No. 3,736,762 discloses a process for producing nitrogen in gaseous and liquefied form from air. A single distillation column is refluxed with nitrogen product condensed in an overhead condenser operated by the reboil of impure oxygen conveyed from the bottom of said column. At least a portion of the impure oxygen from the overhead condenser is expanded to produce refrigeration for the process.

U.S. Pat. No. 3,754,406 discloses a process for the production of low purity oxygen, in which a low pressure stream of incoming air is cooled against outgoing gas streams and fed into a high pressure distillation column. A high pressure stream of incoming air is cooled against outgoing gas stream, partially condensed against boiling oxygen product in a product vaporizer, and separated into gas and liquid streams. The liquid stream being subcooled and expanded into a low pressure fractionating column. The gas stream is reheated and expanded to provide process refrigeration and is introduced into the low pressure fractionating column. Crude liquid oxygen from the bottom of the high pressure column is cooled and introduced into the low pressure column after being used to liquefy some of the nitrogen from the high pressure column in an external reboiler condenser. Liquid oxygen product from the low pressure column is pumped to a higher pressure before being passed to the subcooler and the product vaporizer. The remainder of the high pressure nitrogen is liquefied in a second external reboiler/condenser and is used as reflux for the two columns. A waste nitrogen stream is removed from the low pressure column.

U.S. Pat. No. 4,222,756 discloses a process in which a two pressure distillation column is used in which both pressurized column sections are refluxed with a nitrogen-enriched stream. The low pressure column is fed by a oxygen-enriched stream from the high pressure column which is expanded to reduce its pressure and temperature.

U.S. Pat. No. 4,224,045 discloses a process where oxygen is produced by distillation of liquefied air in a two column unit. A gas turbine, powered in part by a nitrogen product stream, supplies the energy to compress the feed air.

U.S. Pat. No. 4,382,366 discloses an air separation system for the recovery of pressurized, substantially pure oxygen gas. The system uses a single pressure distillation column and burns a nitrogen-oxygen waste stream to provide power for the air compressor, the oxygen product compressor and electric generation. The distillation column has a split feed to develop reflux and reboil and to provide initial separation of the liquid and vapor components of the column.

U.S. Pat. No. 4,400,188 discloses a nitrogen production process wherein a single nitrogen recycle stream refluxes a distillation column which is fed by a single air feed. Waste oxygen from the column is expanded to provide a portion of the necessary refrigeration.

U.S. Pat. No. 4,464,188 discloses a process and apparatus for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

U.S. Pat. No. 4,464,191 discloses an arrangement of distillation columns for subambient distillation of mixtures of two non-condensable gases. The two column arrangement which exchange liquid achieves a given level of separation over a smaller temperature range than a single column producing the same separation. The arrangement of the patent is particularly useful for air separation to produce medium purity (90 to 99%) oxygen and/or nitrogen.

U.S. Pat. No. 4,560,397 discloses a process for the production of ultra high purity oxygen and elevated pressure nitrogen by the cryogenic rectification of air wherein the product oxygen is recovered from a secondary column at a point above the liquid sump while impurities are removed from the column at a distance from the product withdrawal point.

U.S. Pat. No. 4,617,036 discloses a process for the cryogenic distillation of air to recover nitrogen in large quantities and at relatively high pressure, wherein a portion of the nitrogen reflux for the distillation is achieved by heat exchanging nitrogen gas in a side reboiler against waste oxygen at reduced pressure.

U.S. Pat. No. 4,617,037 discloses a nitrogen production method wherein air is compressed, is removed of water and carbon dioxide contained therein, and is simultaneously cooled to a temperature close to the liquefying point. The resultant cleaned and cooled air is fed into a rectifying column for rectification so that high purity nitrogen is removed from the rectifying column overhead and the oxygen-enriched liquid air is withdrawn from the rectifying column bottom and is expanded and fed into a condensation step wherein it becomes a source of reflux for the rectifying column and a source of refrigeration. In the method of the patent, a closed circulating cycle provides additional refrigeration.

U.S. Pat. No. 4,655,809 discloses an air separation system for the recovery of pressurized, substantially pure oxygen gas. The system uses a single pressure distillation column and utilizes the nitrogen product stream to provide power for feed air compression, segregated heat pump fluid compression, and electric generation. The system utilizes a segregated heat pump cycle which provides heat exchange for both column reboil and reflux.

U.S. Pat. No. 4,662,916 and 4,662,917 disclose variations on a process for the separation of air by cryogenic distillation in a single column to produce a nitrogen product and an oxygen-enriched product. In the process, at least a portion of the nitrogen product is compressed and recycled to provide reboil at the bottom of the distillation column and to provide some additional reflux to the upper portion of the column. In addition, part of the compressed air stream is expanded to provide work, which is used to drive an auxiliary compressor for recycle nitrogen stream compression.

U.S. Pat. No. 4,662,918 discloses a process for the separation of air by cryogenic distillation in a single column to produce a nitrogen product and an oxygen-enriched product. In the process, at least a portion of the nitrogen product is compressed and recycled to provide reboil at the bottom of the distillation column and to provide some additional reflux to the upper portion of the column. In addition, part of the compressed nitrogen recycle stream is expanded to provide work.

U.S. Pat. No. 4,702,757 discloses a process utilizing high and low pressure distillation columns for the production of an oxygen-enriched air product. Feed air is fed to the main heat exchangers at two pressures. The high pressure feed air from the main exchanger used to supply refrigeration, by expanding a portion of the high pressure air prior to introducing that portion into an intermediate location in the low pressure column, and to vaporize the oxygen-enriched air product prior to using the stram as reflux for the high pressure column. The low pressure feed air from the main heat exchangers is partially condensed to supply reboiler duty to a low pressure column and is then fed to a high pressure column. The high pressure column condenser is used to reboil an intermediate liquid in the low pressure column.

U.S. Pat. No. 4,704,147 discloses a process for the production of an oxygen-enriched air product, feed air is fed to the main heat exchangers at two pressures. The high pressure feed air from the main exchanger is partially condensed to vaporize the oxygen-enriched air product. This partially condensed feed air is separated with the vapor phase being warmed and expanded to supply refrigeration and subsequently being fed to the low pressure fractionation section, and the liquid phase being used to reflux both the high pressure and low pressure fractionation sections of a double distillation column. The low pressure feed air from the main heat exchangers is fed to the high pressure fractionation section. The high pressure fractionation section condenser is used to provie reboiler duty to the low pressure fractionation section.

U.S. Pat. No. 4,704,148 discloses a process utilizing high and low pressure distillation columns, for the separation of air to produce low purity oxygen and waste nitrogen streams. Feed air from the cold end of the main heat exchangers is used to reboil a low pressure distillation column and to vaporize the low purity oxygen product. This heat duty for column reboil and product vaporization is supplied by splitting the air feed into at least three substreams. One of the substreams is totally condensed and used to provide reflux to both the low pressure and high pressure distillation column, preferably the substream which is fed to the oxygen vaporizer, while a second substream is partially condensed with the vapor portion of the partially condensed substream being fed to the bottom of the high pressure distillation column and the liquid portion providing reflux to the low pressure column. The third substream is expanded to recover refrigeration and then introduced to the low pressure column as column feed. Additionally, the high pressure column condenser is used as an intermediate reboiler in the low pressure column.

SUMMARY OF THE INVENTION

The present invention is an improvement to a nitrogen generator process that utilizes a single cyrogenic distillation column to produce nitrogen, wherein refrigeration for the process is provided by a waste expander or an air expander. Basically, the improvement comprises integrating a secondary distillation column into the process to produce small quantities of high purity oxygen. In operating the process with the secondary column, a portion of oxygen-rich liquid from the sump of the nitrogen generator column overhead condenser is removed and fed to an upper location of the secondary column. Reboil for the secondary column is provided by condensing a portion of nitrogen overhead from the nitrogen generator column in a reboiler/condenser located in the bottom of the secondary column. At least a portion of the condensed liquid nitrogen from the reboiler/condenser located in the bottom of the secondary column is used to provide reflux to the nitrogen generator column. Under some modes of operation, part of this liquid nitrogen can be removed from the process and sent to storage as product liquid nitrogen. The high purity oxygen co-product is recovered from the secondary column at a point in the secondary column above and/or below the reboiler/condenser.

This high purity oxygen co-product is recovered from a waste stream normally vented to the atmosphere in the nitrogen generator proess, without additional operating power or air feed requirements.

DETAILED DESCRIPTION OF THE INVENTION

Figure 1:
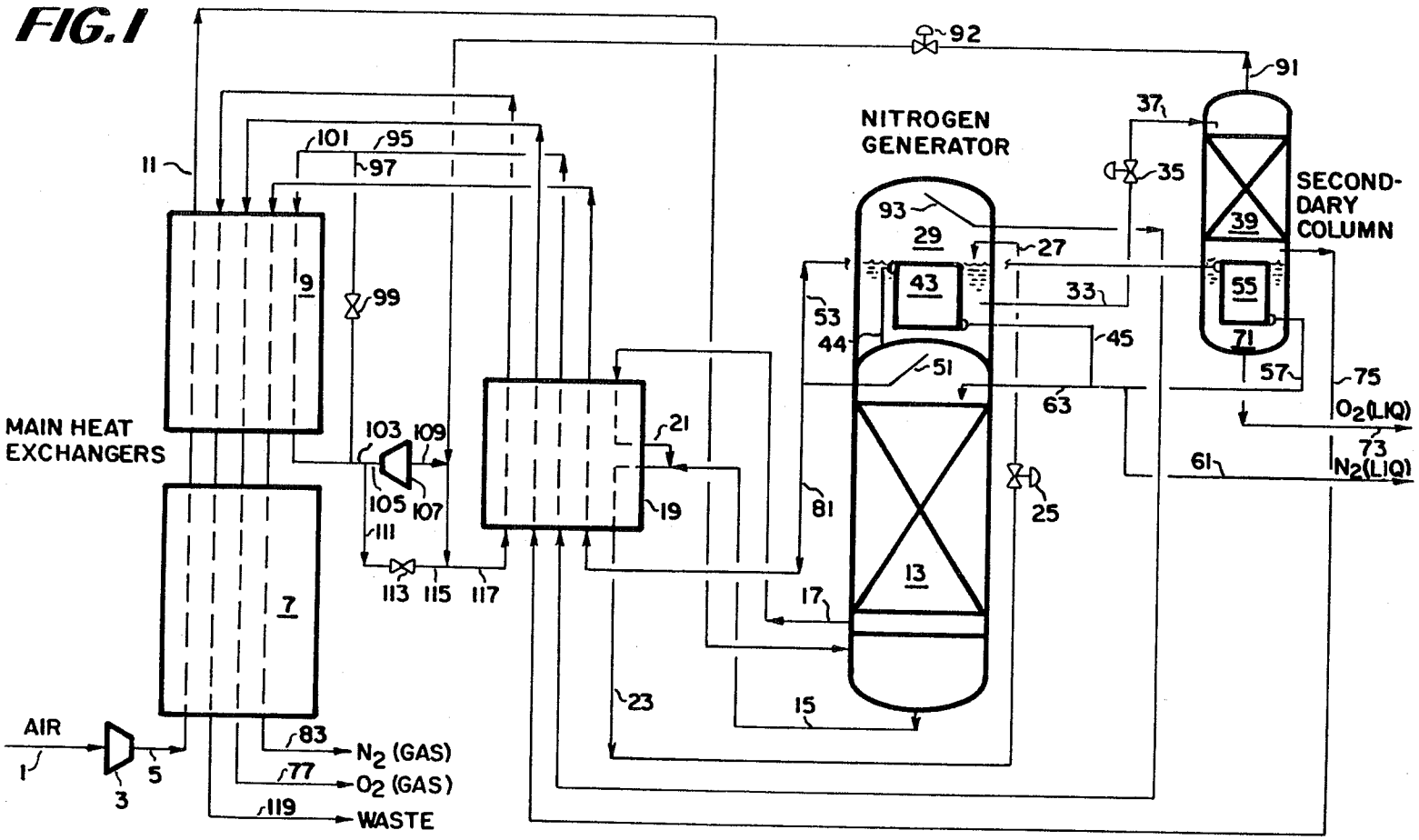
FIG. 1 is a schematic drawing of the process of the present invention for the production of nitrogen and small quantities of high purity oxygen.

There is a need by many users of nitrogen to also have a small supply of high purity oxygen. Typically, the requirement for oxygen is too large to be supplied economically from vaporized liquid oxygen and too small to justify the installation of a separate cryogenic oxygen generator. The concept of a nitrogen generator modified to produce a small amount of high purity oxygen without significant power and capital penalties would be very advantageous for this type of user. The present invention is a solution to this problem.

The present invention is an improvement to a nitrogen generator air separation process utilizing a conventional cryogenic single distillation column nitrogen generator, wherein refrigeration for the process is provided by either a waste expander or an air expander. A nitrogen generator air separation process is one in which air is separated by cryogenic distillation to produce one or more nitrogen product streams and typically the oxygen constituent in the air is removed as a waste stream. Examples of nitrogen generator air separation processes are shown in U.S. Pat. Nos. 3,217,502; 3,735,599; 3,736,762 and 4,617,037, the specifications of which are incorporated herein by reference. Basically, the improvement is the integration of a secondary oxygen column into the nitrogen generator process to produce a high purity oxygen co-product. The high purity oxygen co-product is recovered from the waste stream from the nitrogen generator process, this stream would normally be vented to atmosphere. Oxygen is produced with no additional operating power or air feed requirements. The process of the present invention produces its nitrogen product at elevated pressures, thus for most applications, eliminating the need for product nitrogen compression.

To accomplish the production of the high purity oxygen co-product, a portion of the oxygen-rich liquid from the sump of the nitrogen generator column overhead condenser is fed to an upper location f the secondary column. Reboiling for the secondary column is provided by condensing a portion of the nitrogen overhead from the nitrogen generator column in a reboiler/condenser located in the bottom of the secondary column. The condensed nitrogen liquid is used to provide reflux to the nitrogen generator column, and in some modes of operation, part of the liquid nitrogen can be removed from the process as liquid nitrogen product.

The limit on the amount of oxygen that can be produced is determined by the overall refrigeration requirements for the process. Increasing the feed to the secondary column reduces the amount of boil-up vapor from the reboiler/condenser which feeds the expansion turbine. Large liquid nitrogen and/or oxygen requirements require large expander flows and therefore limit the feed available to the secondary column. Nitrogen recovery, oxygen purity and operating pressure influence the flow requirements for the expansion turbine and thereby affect the oxygen recovery by changing the feed available to the secondary column.

Oxygen recovery can be further increased by one of the following modifications. (1) Liquid nitrogen from an external source can be fed to the main distillation column as reflux, thereby providing additional refrigeration to the process. This additional external refrigeration would decrease the flow required by the expansion turbine and thereby increase the flow available to the secondary column. (2) An expansion turbine could be used to replace the expansion valve which reduces the pressure of the overhead from the secondary column prior to its venting as waste. This work expansion of the secondary column overhead stream (or at least a portion thereof) would provide additional refrigeration to the process and thereby increase the flow available to the secondary column.

Although so far discussed with reference to nitrogen generator process systems which utilizes a single cryogenic distillation column, the present invention is also applicable to nitrogen generator systems which utilizes a double cryogenic distillation column. Examples of double column nitrogen generators are disclosed in U.S. Pat. Nos. 4,222,756; 4,453,957 and 4,617,036, the specifications of which are incorporated herein by reference. In the operation of the process of the present invention in a double column system, liquid feed to the secondary column would be drawn from the main reboiler/condenser space or, where applicable, the top reboiler/condenser.

FIG. 1 shows a preferred embodiment of the process utilizing a single distillation column which produces nitrogen and oxygen at the highest pressure. With reference to FIG. 1, filtered air is fed via line 1 to compressor 3 and compressed to an elevated pressure. This filtered and compressed air is then cooled to cooling water temperatures before entering main heat exchangers 7 and 9 via line 5 (this stage of cooling is not shown). The air is cooled to near its dew point in main exchangers 7 and 9 by indirect heat exchange with the returning products and waste streams. Heat exchangers 7 and 9 could be either reversing heat exchangers to provide water and carbon dioxide removal or non-reversing heat exchangers when front end adsorption systems are used to remove water and carbon dioxide impurities. The cooled air enters nitrogen generator column 13 via line 11 and is separated into a high purity nitrogen overhead and an oxygen-rich bottoms liquid.

A portion of the nitrogen overhead is removed from nitrogen generator column 13 via line 44 and fed to overhead condenser 43 wherein it is condensed and removed via line 45. The remainder of the nitrogen overhead is removed from nitrogen generator column 13 via line 51. This nitrogen stream is split into two substreams, lines 53 and 81, respectively. First substream 53 is fed to reboiler/condenser 55, located in the bottom of secondary column 39, wherein it is condensed and removed as liquid nitrogen via line 57. The liquid nitrogen in lines 45 and 57 are combined, a portion of the combined liquid nitrogen is removed as liquid nitrogen product via line 61; the remainder is fed to the top of nitrogen generator column 13 as reflux. Second substream 81 is heat exchanged in heat exchangers 19, 9 and 7 to recover refrigeration and removed from the process as gaseous nitrogen product via line 83.

A small air sidedraw is removed from nitrogen generator column 13 via line 17 and condensed in heat exchanger (superheater) 19. The condensed sidedraw, now in line 21, is combined with crude liquid oxygen, in line 15, from the bottom of nitrogen generator column 13. This combined stream, line 23, is subcooled in heat exchanger 19 and flashed in valve 25 (forming a two phase mixture) before being fed to overhead space 29 of nitrogen generator column 13 via line 27.

Figure 3:
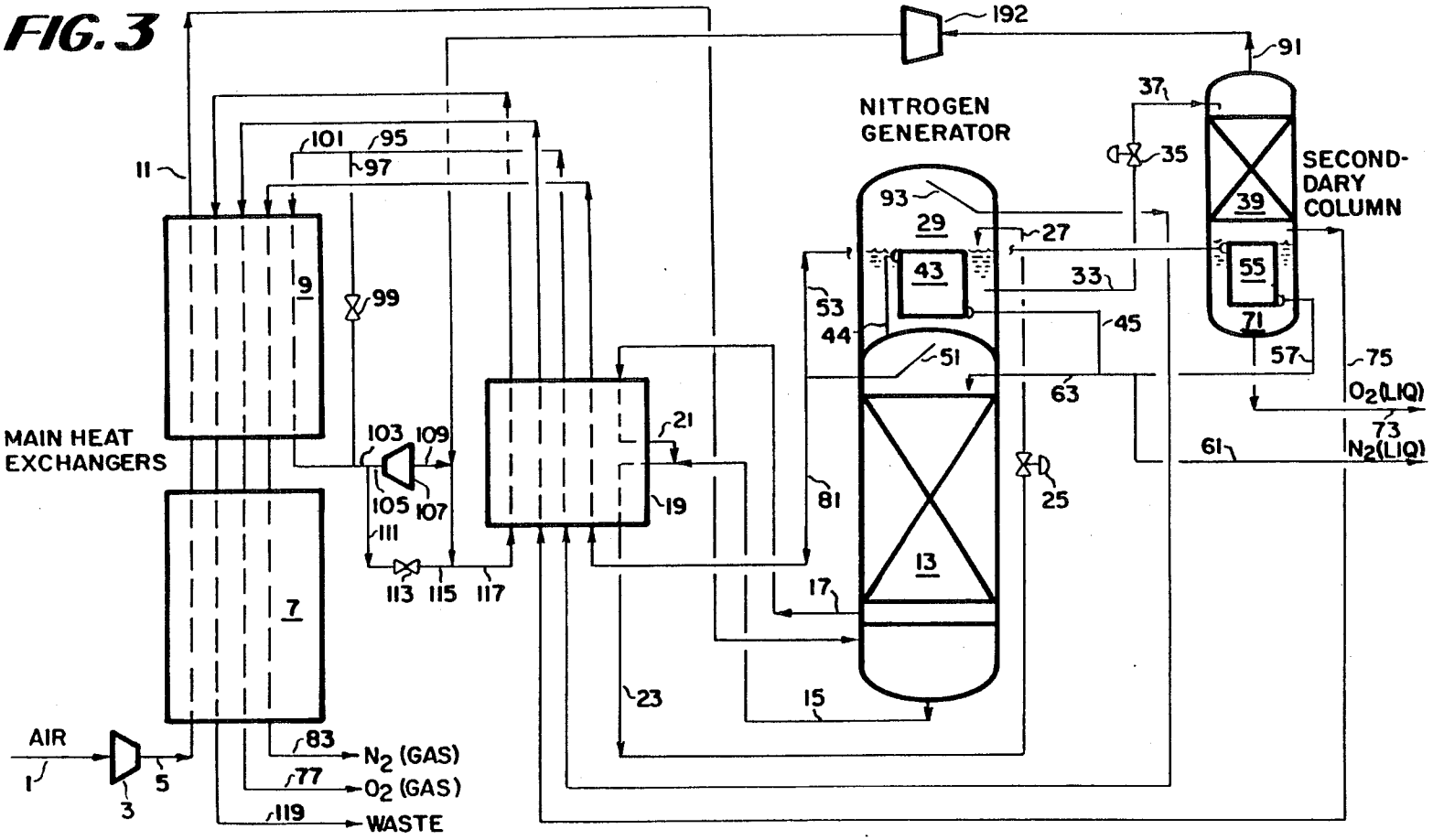
FIG. 3 is a schematic drawing of an alternate embodiment of the process of the present invention for the production of nitrogen and small quantities of high purity oxygen.

A portion of the oxygen-rich liquid in overhead space 29 is removed via line 33, flashed in valve 35 and fed to the top of secondary column 39 via line 37. The remainder of the oxygen-rich liquid in overhead space 29 is vaporized by the condensing nitrogen in reboiler/condenser 43 and removed from column 13 via line 93. This stream 93 is partially warmed in superheater 19. The warmed stream, now in line 95, is split into two substreams, lines 97 and 101, respectively. Substream 97 bypasses heat exchanger 9 by passing through valve 99 and is reunited with substream 101 which has been warmed in heat exchanger 9. The reunited stream, now in line 103, can be split into two portions. First portion 105 is work expanded in expander 107 forming stream 109. Second portion 111 is expanded in valve 113, the amount of material flowing in stream 111 will inversely depend on the amount of oxygen produced by the process. These expanded portions, lines 109 and 115, are combined with the overhead from secondary column 39, via line 91 after passing through pressure reducing valve 92, thereby forming combined stream 117. This valve (92) can also be an expansion turbine, as shown as expander 192 in FIG. 3, and thereby increase the amount of refrigeration available to the process. FIG. 3 is identical to FIG. 1 with the exception that pressure reducing valve 92 has been replaced with expansion turbine 192. This combined stream 117 is warmed in heat exchangers 19, 9 and 7 and removed from the process as a waste stream via line 119.

The feed to the top of the secondary column, line 37, is separated in secondary column 39 to produce high purity oxygen, which is removed as liquid oxygen product from the bottom (71) of column 39 via line 73 and as gaseous product via line 75. The gaseous product is then warmed in heat exchangers 19, 9 and 7 to recover refrigeration and removed as oxygen product from the process via line 77.

As mentioned earlier, water, carbon dioxide and other impurities which may freeze out at cryogenic temperatures can be removed by the use of a reversing heat exchanger or by the use of a front end molecular sieve absorber system. Both the molecular sieve system and the reversing heat exchanger system will provide adequate removal of impurities which freeze out at cryogenic temperatures for this process. Neither system has any significant advantages over the other.

The concept of using a secondary column to produce oxygen from a nitrogen generator process can be applied to basically any nitrogen generator process currently in use today.

The process of the present invention has numerous benefits, among these are the following. The process eliminates the requirement for a second cryogenic air separation plant to produce oxygen or the need to haul in liquid oxygen at sites where a nitrogen plant is needed. The invention is able to produce a small supply of high purity oxygen from a single cryogenic process which produces high purity nitrogen at elevated pressure as the primary product. The nitrogen product is produced at an elevated pressure (essentially main column pressure) which eliminates the need for nitrogen product compression in many applications. Elimination of nitrogen compression is a major advantage over a conventional low pressure oxygen generator which also produces low pressure nitrogen. The oxygen pressure is also at an elevated pressure (relative to a small, conventional oxygen plant process) which will save on oxygen compression costs. The process produces liquid oxygen product that can be stored for later use during plant outages. This invention also has the advantage that if oxygen is not required, the oxygen equipment can be taken out of service and the process can be operated as a conventional nitrogen generator. Additionally, the process can be operated to produce a low purity oxygen product for those applications where high purity oxygen is not required.

In order to demonstrate the efficacy of the present invention and to provide a comparison with the best available prior art, the following examples (computer simulations) were prepared.

EXAMPLE 1

The process of the present invention, as depicted in FIG. 1, was computer simulated to produce a maximum oxygen product. Table I lists operating conditions and stream flows and compositions for selected streams.

EXAMPLE 2

Figure 2:
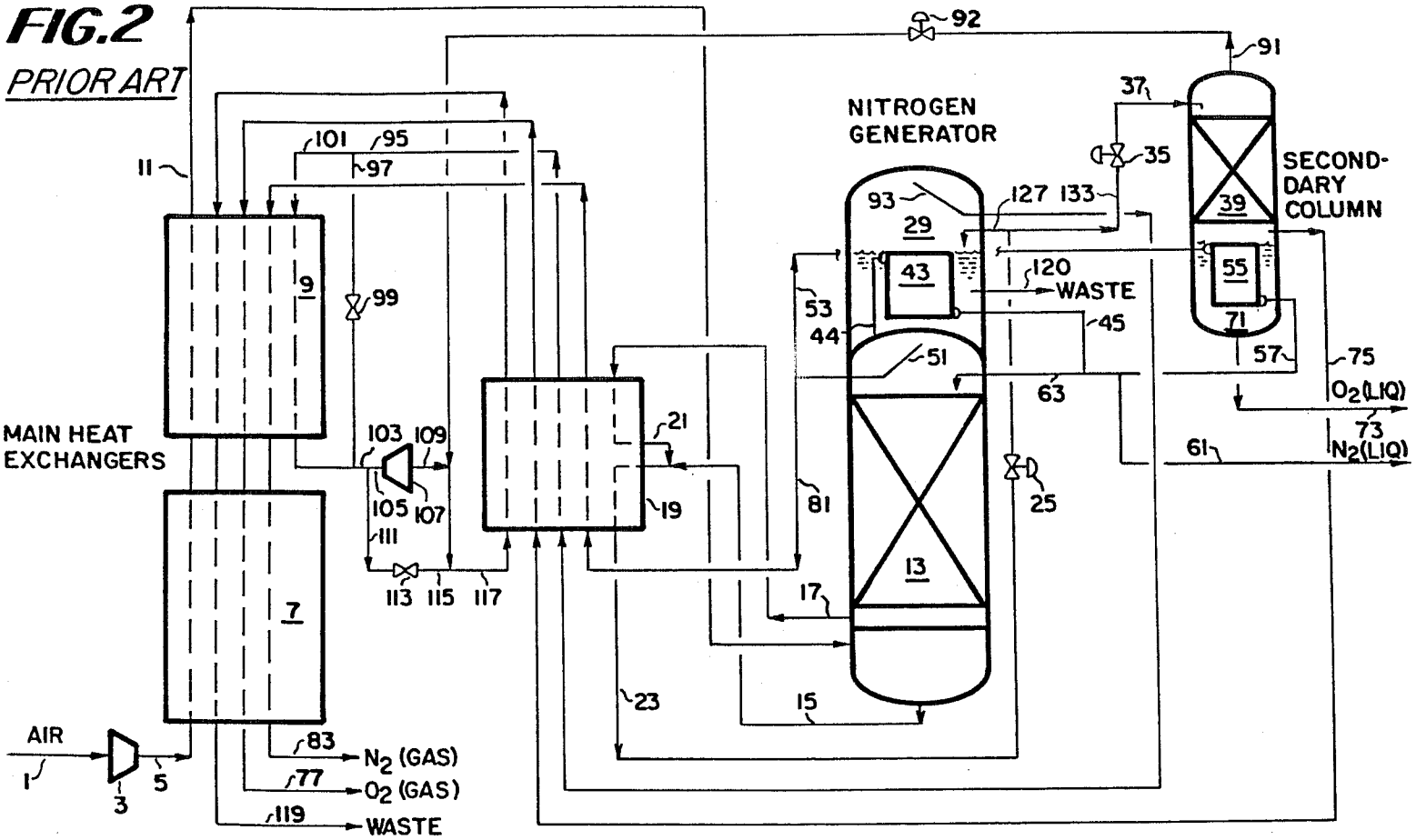
FIG. 2 PRIOR ART
FIG. 2 is a schematic drawing of the process of U.S. Pat. No. 4,560,397, which has been slightly modified to incorporate a reversing heat exchanger and liquid oxygen production.

In order to provide a comparison of the present invention to the closest prior art process, the process cycle of U.S. Pat. No. 4,560,397, as depicted in FIG. 2, was computer simulated to produce maximum oxygen product. The process of U.S. Pat. No. 4,560,397 has been slightly modified to be suitable for a reversing heat exchanger design and liquid oxygen production. Basically, the process of U.S. Pat. No. 4,560,397 is similar to that of the present invention except in several key elements. The differences are evident from the following discussion.

With reference to FIG. 2, the oxygen-rich stream 23 is split into two portions following flashing in valve 25. A first portion is fed to overhead space 29 via line 127 and a second portion, line 133, is flashed in valve 35 and fed to secondary column 39 via line 37. Also a liquid purge stream is withdrawn from overhead space 29 via line 120. The remaining streams are the same as in FIG. 1 and have been assigned common numbers. Table II lists operating conditions and stream flows and compositions for selected streams.

TABLE I

Material Balance and Operating Conditions for Selected Streams
Process of the Present Invention

| Stream Number | Phase | Temperature: °F. | Pressure: psia | Total Flow: lb-mol/hr | Component Flow Rates: lb-mol/hr Nitrogen | Argon | Oxygen |
|---|---|---|---|---|---|---|---|
| 1 | VAP | AMBIENT | 14.7 | 100.00 | 78.12 | 0.93 | 20.95 |
| 5 | VAP | 98.0 | 133.5 | 100.00 | 78.12 | 0.93 | 20.95 |
| 11 | VAP | −265.4 | 131.2 | 100.00 | 78.12 | 0.93 | 20.95 |
| 15 | LIQ | −268.1 | 131.2 | 56.01 | 34.69 | 0.90 | 20.42 |
| 17 | VAP | −268.1 | 131.2 | 2.54 | 1.98 | 0.03 | 0.53 |
| 23 | LIQ | −274.2 | 131.2 | 58.55 | 36.67 | 0.93 | 20.95 |
| 33 | LIQ | −280.8 | 77.6 | 39.49 | 22.11 | 0.70 | 16.68 |
| 53 | VAP | −276.7 | 127.5 | 47.23 | 47.23 | 0.00 | 0.00 |
| 57 | LIQ | −276.7 | 127.5 | 47.23 | 47.23 | 0.00 | 0.00 |
| 61 | LIQ | −276.7 | 127.3 | 0.39 | 0.39 | 0.00 | 0.00 |
| 73 | LIQ | −281.9 | 33.0 | 0.20 | 0.00 | 0.00 | 0.20 |
| 77 | VAP | 92.3 | 30.4 | 7.80 | 0.00 | 0.03 | 7.77 |
| 81 | VAP | −276.7 | 127.5 | 41.06 | 41.06 | 0.00 | 0.00 |
| 83 | VAP | 92.3 | 124.4 | 41.06 | 41.06 | 0.00 | 0.00 |
| 91 | VAP | −296.9 | 31.0 | 31.49 | 22.11 | 0.67 | 8.71 |
| 93 | VAP | −280.9 | 77.6 | 19.06 | 14.56 | 0.23 | 4.27 |
| 95 | VAP | −270.1 | 77.0 | 19.06 | 14.56 | 0.23 | 4.27 |
| 97 | VAP | −270.1 | 77.0 | 6.06 | 4.63 | 0.07 | 1.36 |
| 105 | VAP | −182.5 | 76.0 | 18.75 | 14.32 | 0.23 | 4.20 |
| 109 | VAP | −258.0 | 19.5 | 18.75 | 14.32 | 0.23 | 4.20 |
| 111 | VAP | −182.5 | 76.0 | 0.31 | 0.24 | 0.00 | 0.07 |
| 117 | VAP | −284.3 | 19.2 | 50.55 | 36.67 | 0.90 | 12.98 |
| 119 | VAP | 92.2 | 14.7 | 50.55 | 36.67 | 0.90 | 12.98 |

TABLE II

Material Balance and Operating Conditions for Selected Streams
Prior Art Process (U.S. Pat. No. 4,560,397)

| Stream Number | Phase | Temperature: °F. | Pressure: psia | Total Flow: lb-mol/hr | Component Flow Rates: lb-mol/hr Nitrogen | Argon | Oxygen |
|---|---|---|---|---|---|---|---|
| 1 | VAP | AMBIENT | 14.7 | 100.00 | 78.12 | 0.93 | 20.95 |
| 5 | VAP | 98.0 | 133.5 | 100.00 | 78.12 | 0.93 | 20.95 |
| 11 | VAP | −265.1 | 131.2 | 100.00 | 78.12 | 0.93 | 20.95 |
| 15 | LIQ | −268.1 | 131.2 | 55.76 | 34.49 | 0.90 | 20.37 |
| 17 | VAP | −268.0 | 131.2 | 2.79 | 2.18 | 0.03 | 0.58 |
| 23 | LIQ | −274.2 | 131.2 | 58.55 | 36.67 | 0.93 | 20.95 |
| 53 | VAP | −276.7 | 127.5 | 37.10 | 37.10 | 0.00 | 0.00 |
| 57 | LIQ | −276.7 | 127.5 | 37.10 | 37.10 | 0.00 | 0.00 |
| 61 | LIQ | −276.7 | 127.3 | 0.39 | 0.39 | 0.00 | 0.00 |
| 73 | LIQ | −281.9 | 33.0 | 0.20 | 0.00 | 0.00 | 0.20 |
| 77 | VAP | 92.6 | 30.4 | 5.75 | 0.00 | 0.03 | 5.72 |
| 81 | VAP | −276.7 | 127.5 | 41.06 | 41.06 | 0.00 | 0.00 |
| 83 | VAP | 92.6 | 124.4 | 41.06 | 41.06 | 0.00 | 0.00 |
| 91 | VAP | −298.6 | 31.0 | 27.45 | 20.92 | 0.50 | 6.03 |
| 93 | VAP | −281.0 | 65.1 | 24.95 | 15.67 | 0.40 | 8.88 |
| 95 | VAP | −270.1 | 64.4 | 24.95 | 15.67 | 0.40 | 8.88 |
| 97 | VAP | −270.1 | 64.4 | 11.95 | 7.51 | 0.19 | 4.25 |

TABLE II-continued

| Stream Number | Phase | Temperature: °F. | Pressure: psia | Total Flow: lb-mol/hr | Component Flow Rates: lb-mol/hr Nitrogen | Argon | Oxygen |
|---|---|---|---|---|---|---|---|
| Material Balance and Operating Conditions for Selected Streams Prior Art Process (U.S. Pat. No. 4,560,397) | | | | | | | |
| 105 | VAP | −201.9 | 63.4 | 24.77 | 15.56 | 0.40 | 8.81 |
| 109 | VAP | −264.4 | 19.5 | 24.77 | 15.56 | 0.40 | 8.81 |
| 111 | VAP | −201.9 | 63.4 | 0.18 | 0.11 | 0.00 | 0.07 |
| 117 | VAP | −284.3 | 19.2 | 52.40 | 36.59 | 0.90 | 14.91 |
| 119 | VAP | 92.6 | 14.7 | 52.40 | 36.59 | 0.90 | 14.91 |
| 120 | LIQ | −280.9 | 65.0 | 0.20 | 0.08 | 0.00 | 0.12 |
| 133 | LIQ | −274.2 | 131.2 | 33.40 | 20.92 | 0.53 | 11.95 |

As can be seen, a similar process described in U.S. Pat. No. 4,560,397 produces both high purity nitrogen and oxygen from a cryogenic air separation process. This process employs a single column nitrogen generator cycle with a secondary column to produce ultra high purity oxygen. Although there are many similarities between this process and the process of the present invention, there are also some significant differences:

The process of the present invention feeds all of the liquid from the bottom of the main column to the overhead reboiler/condenser and then feeds liquid from the reboiler/condenser to the secondary column. This extra step enriches the feed to the secondary column and reduces the number of theoretical distillation stages required or increases product recovery with the same number of distillation stages. Patent 4,560,397 splits the liquid from the bottom of the main column between the reboiler/condenser and the secondary column. This does not take advantage of the oxygen enrichment in the reboiler/condenser.

Additionally, feeding the secondary column from the reboiler/condenser causes the liquid phase to be richer in nitrogen (about 56% N2) than the liquid phase in the reboiler/condenser of the process in Pat. No. 4,560,397 (about 39% N2). The higher concentration of nitrogen allows the reboiler/condenser to operate at a higher pressure and thus a higher inlet pressure to the expansion turbine. This higher pressure will result in more refrigeration available for liquid production. Also, for a fixed refrigeration load, this higher pressure will reduce the expander flow and increase the flow available to the secondary column resulting in an increase in oxygen production.

Another difference of U.S. Pat. No. 4,560,397, as depicted in the patent itself, is the use of a mechanical pump to return some of the liquid from the bottom of the secondary column to the reboiler/condenser on the main column. The proposed process eliminates the mechanical pump by continuously withdrawing a liquid oxygen stream from the bottom of the secondary column. This stream can be stored as liquid oxygen or vaporized and used as gaseous product. Eliminating the pump reduces the maintenance associated with pumps and improves the overall reliability and efficiency of the process.

These differences result in a major difference in the amount of oxygen product which can be produced by the two processes. The process of the present invention can produce, when operated in a maximum oxygen production mode, 7.8 lb-mols of high purity gaseous oxygen and 0.2 lb-mols of high purity liquid oxygen for every 100 lb-mols of air fed to the process. On the other hand, the process of U.S. Pat. No. 4,560,397, when operated in a maximum oxygen production mode, can only produce 5.75 lb-mols of high purity gaseous oxygen and 0.2 lb-mols of high purity liquid oxygen for every 100 lb-mols of air fed to the process. This is an increase of over 34% in the amount of high purity oxygen producible by the process of the present invention, i.e. a 34% increase in production without an increase in air feed to the process, a reduction in the amount of nitrogen product, or an increase in the energy required to drive the process. This difference is a significant improvement in the art.

The present invention has been described with reference to a specific embodiment thereof. This embodiment and its supportive example should not be considered a limitation on the scope of the invention, such scope should be ascertained by the following claims.

We claim:

1. In a nitrogen generator air separation process which utilizes a cryogenic single distillation column nitrogen (nitrogen generator) and either a waste expander or an air expander for the provision of refrigeration, wherein the cryogenic single distillation column has an overhead condenser and a sump surrounding the overhead condenser, the improvement for producing a high purity oxygen co-product comprising:

(a) integrating a secondary distillation column into the process;

(b) removing a portion of oxygen-rich liquid from the sump of the nitrogen generator column overhead condenser and feeding said oxygen-rich liquid to an upper location of the secondary distillation column;

(c) providing reboil for the secondary distillation column by condensing a portion of nitrogen overhead from the nitrogen generator column in a reboiler/condenser located in the bottom of the secondary distillation column;

(d) utilizing at least a portion of the condensed nitrogen liquid from the reboiler/condenser located in the bottom of the secondary distillation column to provide reflux to the nitrogen generator column; and (e) recovering the high purity oxygen co-product from the secondary distillation column;

whereby the high purity oxygen co-product is recovered from a waste stream normally vented to the atmosphere in the nitrogen generator process and is accomplished without additional operating power or air feed requirements.

2. The process of claim 1 which further comprises work expanding at least a portion of the overhead from the secondary distillation column prior to its removal as waste.

* * * * *